US007118246B2

(12) United States Patent
Sansolo

(10) Patent No.: US 7,118,246 B2
(45) Date of Patent: Oct. 10, 2006

(54) FLASHLIGHT KIT

(76) Inventor: Arie Sansolo, 19 Harol Street, Afridar, Ashkelon 78649 (IL)

( * ) Notice: Subject to any disclaimer, the term of this patent is extended or adjusted under 35 U.S.C. 154(b) by 17 days.

(21) Appl. No.: 10/857,871

(22) Filed: Jun. 2, 2004

(65) Prior Publication Data

US 2005/0128739 A1 Jun. 16, 2005

(51) Int. Cl.
*F21L 4/00* (2006.01)

(52) U.S. Cl. ..... 362/191; 362/190

(58) Field of Classification Search ..... 362/190, 362/191, 382, 396, 398
See application file for complete search history.

(56) References Cited

U.S. PATENT DOCUMENTS 4,797,517 A * 1/1989 Ohashi ..... 200/60
5,014,171 A * 5/1991 Price, III ..... 362/277
5,439,213 A * 8/1995 Pimentel ..... 473/386
5,445,373 A * 8/1995 Franks ..... 473/409
6,305,819 B1 * 10/2001 Chen ..... 362/186
6,669,353 B1 * 12/2003 Kung ..... 362/191

* cited by examiner

*Primary Examiner*—Thomas M. Sember
*Assistant Examiner*—Adam C. Rehm
(74) *Attorney, Agent, or Firm*—Dekel Patent Ltd.; David Klein

(57) ABSTRACT

A flashlight kit including a flashlight including a body including a light and a battery disposed in the body, which is electrically connectable to the light with a switch, and an attachment device for attaching the body to an attachment surface, the attachment device including a spike for jabbing the attachment surface. The spike may be shorter, the same as, or longer than the body.

12 Claims, 5 Drawing Sheets

FLASHLIGHT KIT

FIELD OF THE INVENTION

The present invention relates generally to flashlights, and particularly to a flashlight attachable to different surfaces and a kit therefor.

BACKGROUND OF THE INVENTION

Various types of flashlight accessories have been described in the patent literature.

U.S. Pat. No. 4,938,440 to Weinfield shows a portable, rotatable holder for a flashlight comprises a base structure, an upright housing secured thereto, a receptacle for receiving and releasably holding a flashlight and means for dual rotational movement of the clamped flashlight to a desired position.

U.S. Pat. No. 4,907,769 to Hunley Jr. et al. shows a flashlight holder in a C-shaped configuration having an arm, which fits into a bracket and is held at the desired angle by a screw and a nut. Magnets may secure the holder to a car, truck or the like.

U.S. Pat. No. 2,638,297 to Weinberger shows an article holder, which has a resilient gripping clip which may grip a flashlight. Spring blades also engage the lower part of the flashlight and may be rotated to form a supporting base.

U.S. Pat. No. 6,267,487 to Tucker et al. shows a holder to support a portable light, which includes a base, at least one strap attached to the base adapted to pass around the object to secure the object to the base, a magnetic portion to attach the holder to a steel surface so that the object secured thereto is located adjacent the surface, and a bridge portion attaching the magnetic portion to the base, such that the magnetic portion and said base are spaced from and parallel to one another. The magnetic portion extends in a first direction from the bridge portion and the base extends in a direction opposite to the direction of extension of the magnetic portion.

U.S. Pat. No. 5,577,697 to Accordino shows a flashlight accessory including a connector bar having two clamps rotatably mounted at each end of the bar. A magnet is mounted on the connector bar between the respective clamps.

SUMMARY OF THE INVENTION

The present invention seeks to provide a novel flashlight attachable to different surfaces and a kit therefor, as is described more in detail hereinbelow.

There is thus provided in accordance with an embodiment of the present invention a flashlight kit including a flashlight including a body including a light and a battery disposed in the body, which is electrically connectable to the light with a switch, and an attachment device for attaching the body to an attachment surface, the attachment device including a spike for jabbing the attachment surface. The spike may be shorter, the same as, or longer than the body.

In accordance with an embodiment of the present invention an additional attachment device may be provided for attaching the body to an attachment surface, such as but not limited to, an adhesive element, a magnet, a telescopic pole, a cord, and/or a threaded fastener.

Further in accordance with an embodiment of the present invention a reflective surface may be attached to the outer surface of the body, positioned to reflect light rays emanating from the light. The reflective surface may be attached to a magnet on the body.

Still further in accordance with an embodiment of the present invention the switch is rotatable to turn on and off the light.

In accordance with an embodiment of the present invention a translucent colored cap is placeable over the light.

Further in accordance with an embodiment of the present invention the light includes at least one of a directional light, an infrared light, an ultraviolet light, and a blinking light.

In accordance with an embodiment of the present invention the kit further includes a marker including an umbrella cloth connected to and openable and closeable by an umbrella mechanism, the umbrella mechanism being mounted on a spike.

Further in accordance with an embodiment of the present invention the kit may include a base for mounting thereon a pole for supporting the flashlight, the base including a plurality of nesting legs pivotally mounted about a central pivot on the base.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENT

Figure 1:
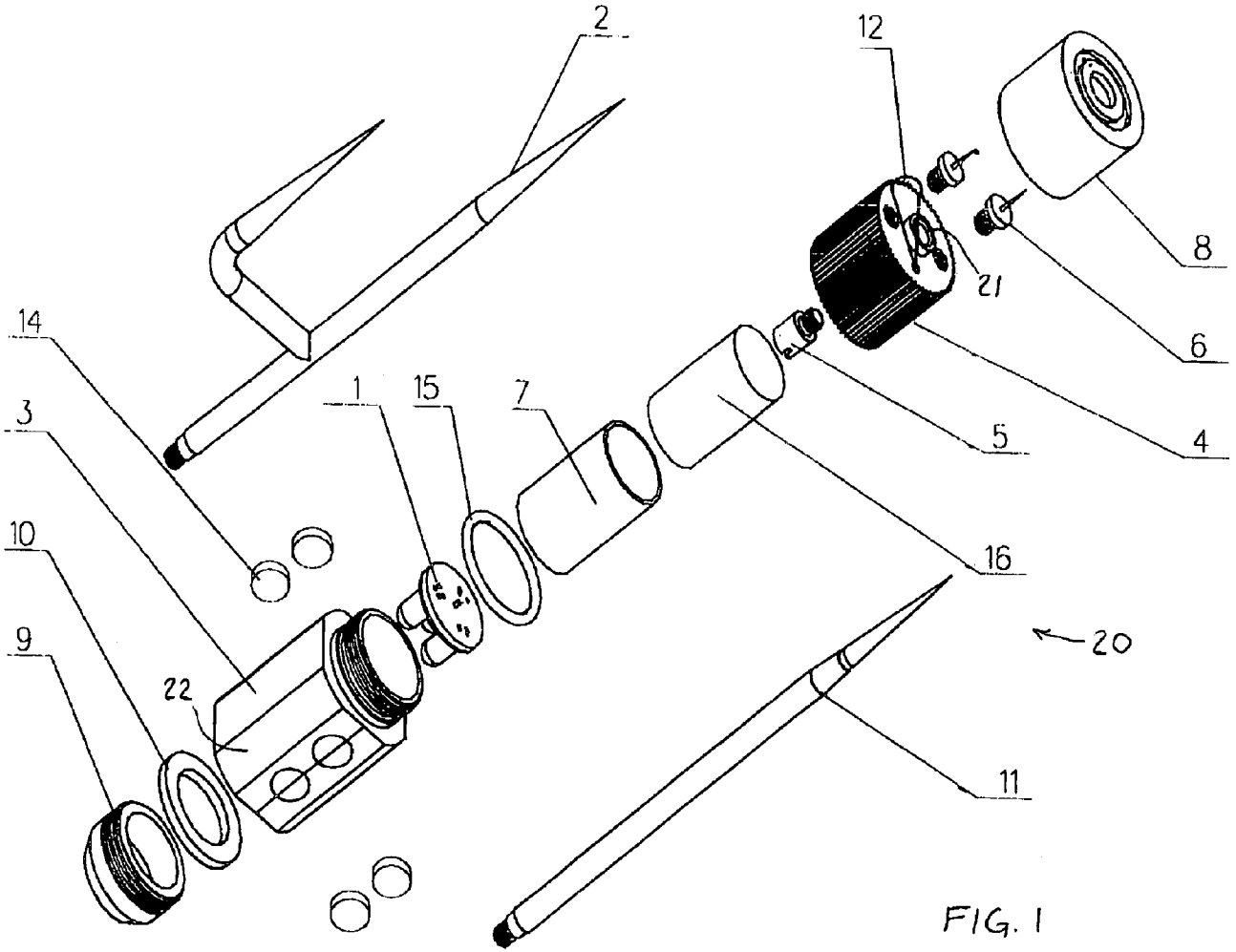
FIGS. 1 and 2 are simplified exploded and pictorial illustrations, respectively, of a flashlight, constructed and operative in accordance with an embodiment of the present invention.
Figure 2:
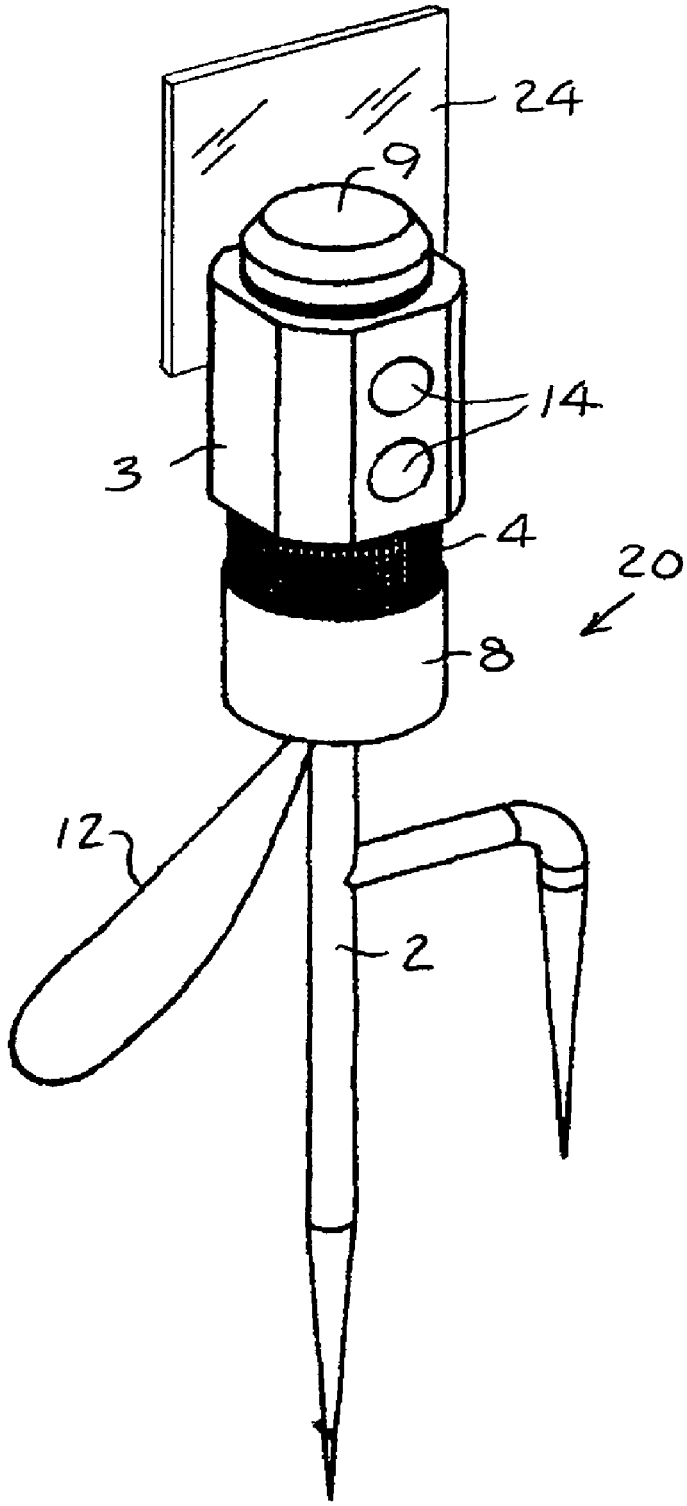

Reference is now made to FIGS. 1 and 2, which illustrate a flashlight kit 20, constructed and operative in accordance with an embodiment of the present invention.

Flashlight kit 20 may comprise a flashlight having a body 3, which includes a light 1 and a battery 16 disposed in body 3. (Any number of flashlights may be provided in the kit, of any size, shape and colored light.) Light 1 may comprise any suitable light, such as but not limited to, a directional light, an infrared light, an ultraviolet light, and/or a blinking light. Light 1 in the illustrated embodiment comprises an LED assembly mounted on a plate that fits inside body 3. A translucent colored cap 9 (of any color; an assortment of colored caps may be provided in the kit) may be placed over light 1, by being screwed on to body 3. A washer 10 may secure the attachment of cap 9 to body 3. Battery 16, which may be any kind of suitable battery, may be disposed in a protective sleeve 7 (e.g., made of a polyamide), brought into contact with light 1, and sealed in place with an O-ring 15. Battery 16 may be electrically connectable to light 1 with a switch 4. Switch 4 may comprise a cylindrical housing, which is rotatable to turn on and off light 1. A contact 5 may effect a connection between the switch 4 and battery 16. It is appreciated that the invention is not limited to this construction, however.

One or more attachment devices may be provided for attaching body 3 to an attachment surface (not shown). For example, the attachment device may comprise one or more spikes 6 for jabbing the attachment surface. The spikes 6 may be used to mount the flashlight on earth surfaces or other compliant surfaces. The spikes 6 are shorter than body 3, and may be screwed onto the switch housing. A protective cap 8 may be provided to prevent accidental pricking when the flashlight is not in use. If desired, spikes 6 may be constructed to be able to pierce protective cap 8 (e.g., spikes 6 may be made of steel and cap 8 may be made of polyamide).

Additionally or alternatively, various elongate pointed rods (that is, spikes which are at least as long as body 3) may be provided for mounting the flashlight on earth surfaces or other compliant surfaces. For example, a pointed rod 11 may be provided, or a double spiked rod 2, which may be screwed on to a threaded fastener 21 (in the illustration, having female threads).

Other additional attachment devices may be provided for attaching body 3 to an attachment surface (not shown). For example, magnets 14 may be mounted flush on an outer longitudinal surface of body 3, flush with body 3. An adhesive element 22, such as double-sided tape, may also be provided. A cord 12 may be provided for hanging the flashlight from some object (not shown).

As seen in FIG. 2, a reflective surface 24 (e.g., a mirror) may be attached to the outer surface of body 3, positioned to reflect light rays emanating from light 1. The reflective surface 24 may be attached to magnet 14, for example.

Figure 3:
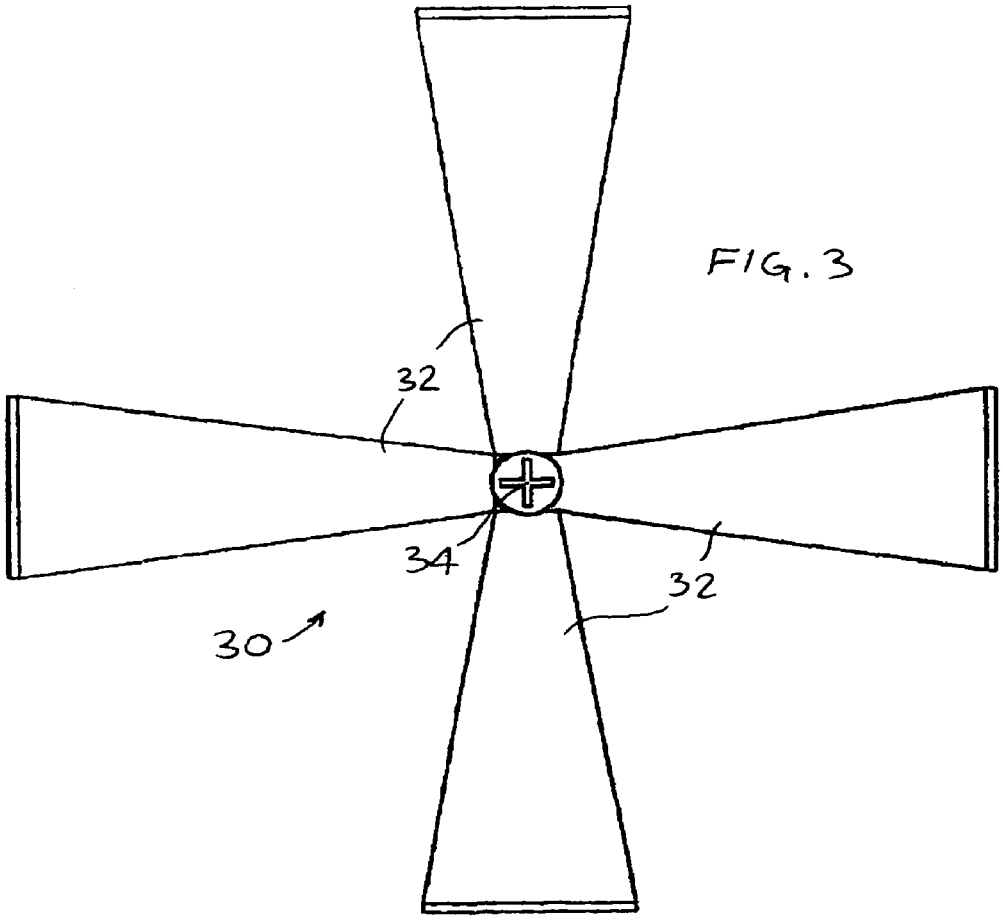
FIGS. 3 and 4 are simplified bottom-view and side-view illustrations, respectively, of a base for mounting the flashlight, constructed and operative in accordance with an embodiment of the present invention.
Figure 4:
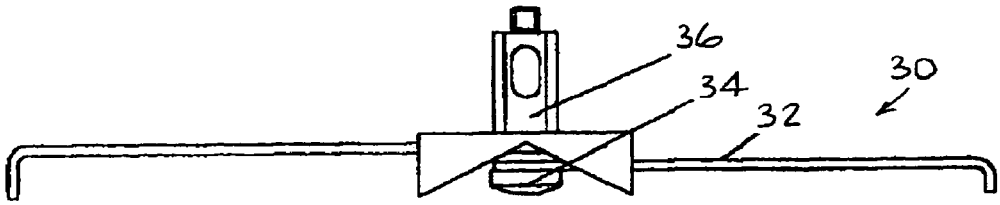
Figure 5:
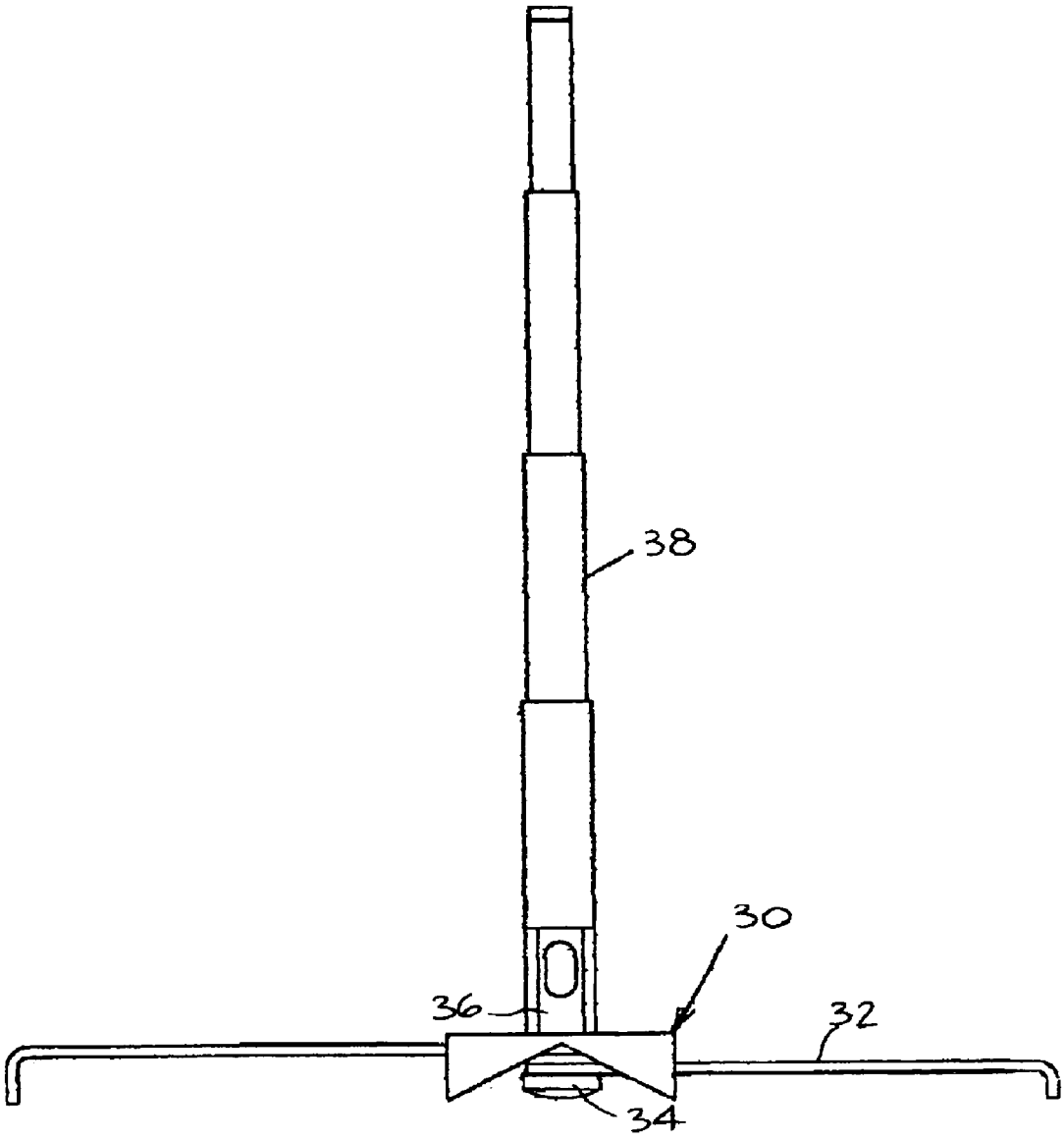
FIG. 5 is a simplified pictorial illustration of a telescopic pole attached to the base, which may be used for mounting the flashlight thereon, in accordance with an embodiment of the present invention.

Reference is now made to FIGS. 3 and 4, which illustrate a base 30 for mounting the flashlight, constructed and operative in accordance with an embodiment of the present invention. The base 30 may comprise a plurality of nesting legs 32 pivotally mounted about a central pivot 34. A threaded hub 36 may protrude upwards form base 30. As seen in FIG. 5, a telescopic pole 38 may be screwed to hub 36. The flashlight may be mounted on pole 38, such as by the magnet 14 or any other method. Additionally or alternatively, various other marker devices, such as but not limited to, tassels or flags, may be mounted on pole 38.

Figure 6:
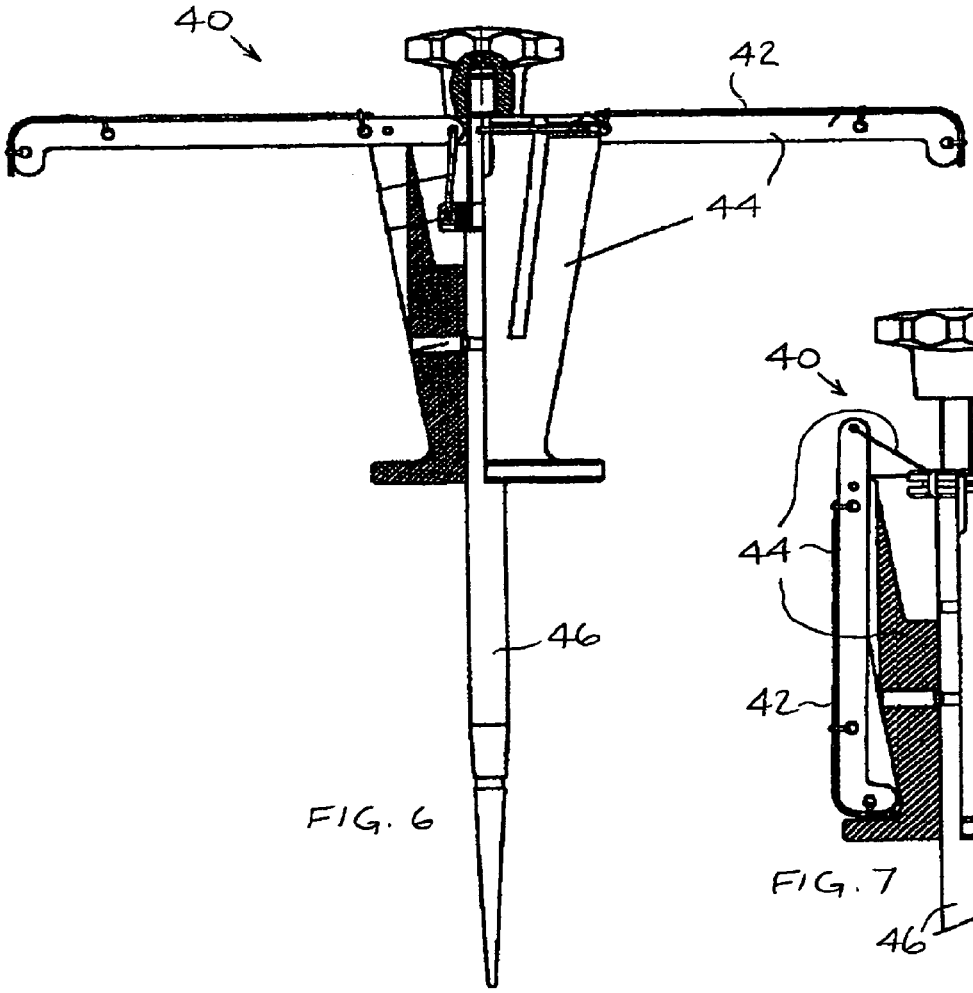
FIGS. 6 and 7 are simplified pictorial illustrations of an umbrella marker, constructed and operative in accordance with an embodiment of the present invention, in respective open and closed orientations.
Figure 7:
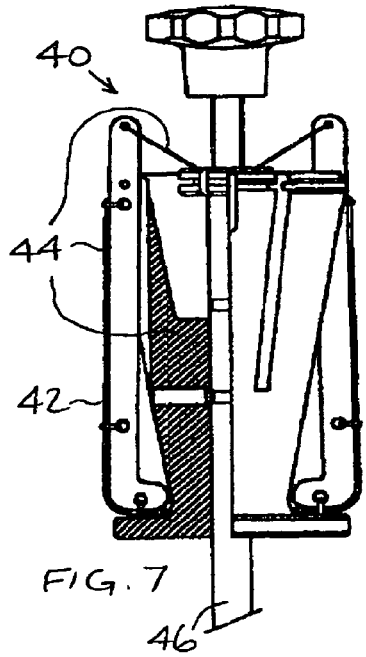

Reference is now made to FIGS. 6 and 7, which illustrate a marker 40 constructed and operative in accordance with an embodiment of the present invention, which may be provided in the flashlight kit. Marker 40 may comprise an umbrella cloth 42, of any size, shape and color, attached to and openable and closeable by an umbrella mechanism 44. The umbrella mechanism 44 may be mounted on a spike 46. Marker 40 (or the flashlights, tassels or flags) may be used in military exercises to mark territory, personnel, equipment, and the like.

It will be appreciated by persons skilled in the art that the present invention is not limited by what has been particularly shown and described hereinabove. Rather the scope of the present invention includes both combinations and sub-combinations of the features described hereinabove as well as modifications and variations thereof which would occur to a person of skill in the art upon reading the foregoing description and which are not in the prior art.

What is claimed is:

1. A flashlight kit comprising:

a flashlight comprising a body including a light and a battery disposed in said body, which is electrically connectable to said light with a switch;

an attachment device for attaching said body to an attachment surface, said attachment device comprising a spike for jabbing the attachment surface, wherein said spike is attached to a portion of said switch, and a protective cap fittable over said spike, wherein said spike is adapted to pierce said protective cap.

2. The flashlight kit according to claim 1, wherein said spike is shorter than said body.

3. The flashlight kit according to claim 1, further comprising an additional attachment device on said body for attaching said body to an attachment surface.

4. The flashlight kit according to claim 3, wherein said additional attachment device comprises at least one of an adhesive element, a magnet, a telescopic pole, a cord, and a threaded fastener.

5. The flashlight kit according to claim 1, further comprising a reflective surface attached to the outer surface of said body, positioned to reflect light rays emanating from said light.

6. The flashlight kit according to claim 5, wherein said reflective surface is attached to a magnet on said body.

7. The flashlight kit according to claim 1, wherein said switch is rotatable to turn on and off said light.

8. The flashlight kit according to claim 1, further comprising a translucent colored cap placeable over said light.

9. The flashlight kit according to claim 1, wherein said light comprises at least one of a directional light, an infrared light, an ultraviolet light, and a blinking light.

10. The flashlight kit according to claim 1, further comprising a marker comprising an umbrella cloth connected to and openable and closeable by an umbrella mechanism, said umbrella mechanism being mounted on a spike.

11. The flashlight kit according to claim 1, further comprising a base for mounting thereon a pole for supporting said flashlight, said base comprising a plurality of nesting legs pivotally mounted about a central pivot on said base.

12. The flashlight kit according to claim 1, wherein said spike is screwed onto a housing of said switch.

* * * * *